US005970828A

United States Patent [19]

Bondhus et al.

[11] Patent Number: 5,970,828

[45] **Date of Patent: *Oct. 26, 1999**

[54] FOLDING HAND TOOL SET

[75] Inventors: John R. Bondhus, Buffalo; Michael D. Blackston, Plymouth; Barry Bondhus, Lester Prairie; Dennis A. Burda, Buffalo; Mark L. Petroske, Becker, all of Minn.

[73] Assignee: Bondhus Corporation, Monticello, Minn.

[ * ] Notice: This patent is subject to a terminal disclaimer.

[21] Appl. No.: 09/109,735

[22] Filed: Jul. 2, 1998

Related U.S. Application Data

[63] Continuation of application No. 08/698,653, Aug. 16, 1996, Pat. No. 5,791,211, which is a continuation-in-part of application No. 08/599,948, Feb. 14, 1996, abandoned.

[51] Int. Cl.[6] ..... B25B 23/00

[52] U.S. Cl. ..... 81/440; 81/900

[58] Field of Search ..... 81/439, 440, 177.1, 81/177.4, 489, 490, 900; 7/118, 167, 168

[56] References Cited

U.S. PATENT DOCUMENTS

| | | |
|---|---|---|
| 647,528 | 4/1900 | Schmidt . |
| 1,337,769 | 4/1920 | Hemming . |
| 1,398,583 | 11/1921 | Bovee . |
| 1,500,852 | 7/1924 | Shepard . |
| 2,332,656 | 10/1943 | Mirando . |
| 2,804,970 | 9/1957 | Kuc et al. . |
| 3,061,927 | 11/1962 | Von Frankenberg et al. . |
| 3,257,991 | 6/1966 | Mosch . |
| 3,943,801 | 3/1976 | Yates . |
| 4,384,499 | 5/1983 | Shockley . |
| 4,882,841 | 11/1989 | Margolis . |
| 5,062,173 | 11/1991 | Collins et al. . |
| 5,146,815 | 9/1992 | Scott, III . |
| 5,263,389 | 11/1993 | Frazzell et al. . |
| 5,271,300 | 12/1993 | Zurbuchen et al. . |
| 5,320,004 | 6/1994 | Hsiao . |
| 5,450,774 | 9/1995 | Chang . |
| 5,495,942 | 3/1996 | Izhak . |
| 5,553,340 | 9/1996 | Brown, Jr. . |
| 5,581,834 | 12/1996 | Collins . |
| 5,592,859 | 1/1997 | Johnson et al. . |
| 5,791,211 | 8/1998 | Bondhus et al. ..... 81/440 |

FOREIGN PATENT DOCUMENTS

WO 97/29887 8/1997 WIPO .

OTHER PUBLICATIONS

Bondhus The Original Industrial Quality Ballpoint Tool, Bondhus Corporation May 1995 (12 pages).

Photocopies of Bondhus tools utilizing 2–piece plastic handles purchased from Chesco (7 pages).

*Primary Examiner*—David A. Scherbel
*Assistant Examiner*—Joni B. Danganan
*Attorney, Agent, or Firm*—Faegre & Benson LLP

[57] ABSTRACT

A folding hand tool set having a one-piece, completely integral, plastic handle and a plurality of hand tools rotatably mounted thereto. The one-piece, completely integral, plastic handle is preferably constructed from a fiber reinforced thermoplastic. In one embodiment, spacers are provided for mechanically isolating the hand tools. The folding hand tool set is capable of transmitting more then 110.0 Newton·meters of torque without compromising the integrity of the one-piece, completely integral plastic handle. The present invention is also directed to a one-piece, completely integral, plastic handle for receiving hand tools. The handle can withstand at least 30 Newton·meters of torsional force without compromising the integrity of the handle.

15 Claims, 5 Drawing Sheets

FOLDING HAND TOOL SET

The present invention is a continuation of U.S. patent application Ser. No. 08/698,653 filed on Aug. 16, 1996, now U.S. Pat. No. 5,791,211 which is a continuation-in-part of U.S. patent application Ser. No. 08/599,948 entitled Folding Hand Tool Set, filed on Feb. 14, 1996 now abandoned.

Field of the Invention

The present invention is directed to a one-piece, completely integral, plastic handle for a folding hand tool set, more particularly, to a one-piece, completely integral, plastic handle containing a plurality of hand tools that permits high levels of torque to be generated without compromising the integrity of the plastic handle.

BACKGROUND OF THE INVENTION

Hand tools are typically discrete items that can be easily misplaced. To overcome this problem, various hand tool set holders have been developed in which a plurality of hand tools is secured in a moveable manner so as to avoid individual tools being lost. However, in order to accommodate a sufficient number of tools into a single holder or container, the overall sizes of the tools tend to be reduced and the handle is often relied upon to transmit torque through the tool to the workpiece.

Various types of handles for tool sets have been developed, such as two-piece metal and plastic handles, and one-piece stamped metal handles. Current metal handles are subject to corrosion and add significant weight and cost to the tool sets. Current two-piece plastic handles lack the strength to transmit higher levels of torque required for certain applications. Finally, one-piece handles, whether metal or plastic can be more expensive to assemble then their two-piece counterparts.

SUMMARY OF THE INVENTION

The present invention is directed to a folding hand tool set having a one-piece, completely integral, plastic handle constructed of a thermoplastic and a plurality of hand tools rotatably mounted thereto. In the preferred embodiment, the thermoplastic is fiber reinforced and the folding hand tool set is capable of transmitting more then 110 Newton·meters of torque without compromising the integrity of the one-piece, completely integral, plastic handle, more preferably more than 120 Newton·meters of torque, and most preferably more than 135 Newton·meters of torque.

The present invention is also directed to a one-piece, completely integral, plastic handle for a folding hand tool set constructed of a thermoplastic. In an embodiment where the thermoplastic is fiber reinforced, the handle can withstand at least 30 Newton·meters of torsional force without compromising the integrity of the handle.

The one-piece, completely integral, plastic handle on the folding hand tool set includes first and second elongated side walls arranged in a generally parallel configuration. The sidewalls are joined along a center portion of an inner surface thereof by a center rib. First and second mounting ends are located on opposite ends of the handle. Outer surfaces of the elongated side walls form a gripping surface. The center rib is positioned to form first and second recesses with the side walls for receiving hand tools along a longitudinal axis of the folding hand tool set. The center rib further includes a first reinforcing web proximate the first mounting end to form a portion of a second recess. A second reinforcing web may be located proximate the second mounting end for forming a portion of the first recess.

The plurality of hand tools is rotatable from a first position within the first or second recesses to a second position at least 270° from the first position. It will be understood that the hand tools may be rotated more or less then 270° without departing from the scope of the present invention. The first and second webs form end stops for the second position of the hand tools. In an embodiment in which a hand tool is rotated approximately 270° against an end stop, the end stop reduces the risk that the tool will collapse into the handle when high levels of torque are applied.

One or more of the hand tools may be separated by a spacer or washer. In the preferred embodiment, the spacer or washer is fixedly engaged with the handle so that torque generated from the rotation of a tool from the first position to the second position is not transmitted to adjacent tools.

The one-piece, completely integral, plastic handle is preferably constructed from fiber reinforced thermoplastics. The fibers are preferably aligned or oriented along the longitudinal axis of the handle. Suitable reinforcing materials include aramid, carbon, glass, polyester or mica fibers, or some combination thereof.

In one embodiment, the gripping surface curves inward toward the center rib proximate the center portion to facilitate gripping by the user. Alternatively, the gripping surface may be straight or curve outward proximately the center portion. The center rib may include a center reinforcing member proximate the center portion of the first and second sidewalls. In one embodiment, the reinforcing member is a 'S'-shaped curve in the center rib.

A pair of opposing raised shoulders may be located on opposing inner surfaces of the first and second sidewalls proximate the first and second mounting ends. One or more side wall supports may be located along a portion of an inner surface of a sidewall and a portion of the center rib. The side wall supports may also serve to offset the hand tools from the inner surface of the sidewalls to facilitate removal from the handle. The sidewalls of the handle are preferably curved or bowed outward along the top and bottom edges thereof proximately the center portion so that the height or thickness of the sidewalls is greater at the center then at the mounting ends.

A variety of hand tools may be included in the folding hand tool set of the present invention, including hex wrenches, screwdrivers, Torx® drivers, open end wrenches, box end wrenches or some combination thereof.

As used in this application the expression "compromise to the integrity of the handle" shall mean permanent damage such as inelastic deformation, visible cracks, or catastrophic failure.

DETAILED DESCRIPTION OF THE PREFERRED EMBODIMENTS

Figure 1:
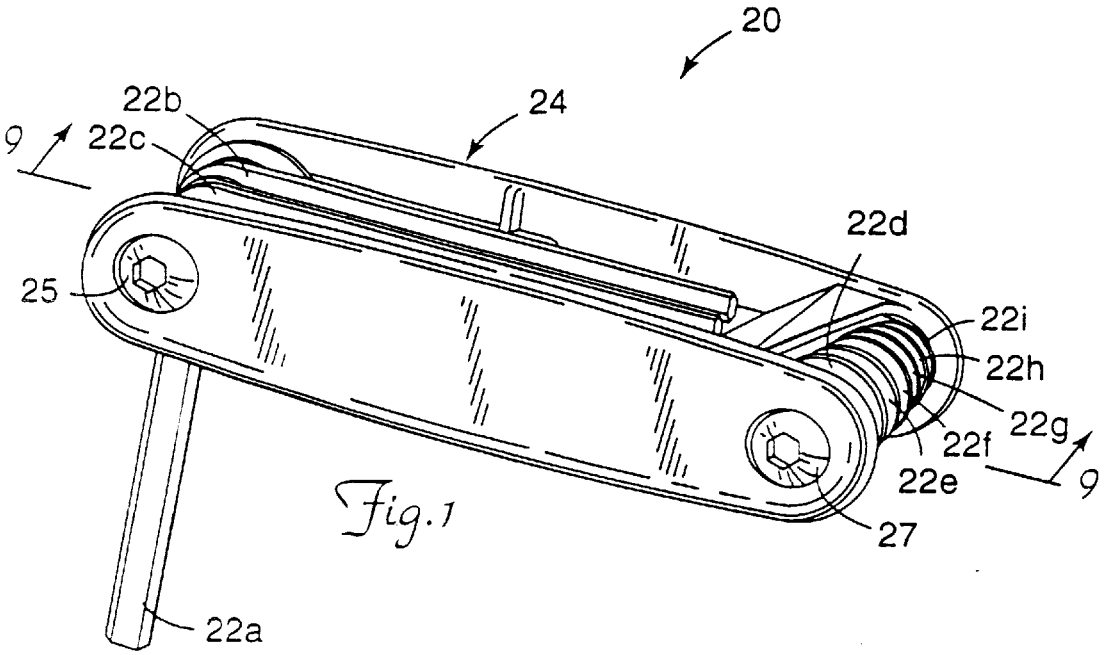
FIG. 1 is a perspective view of an exemplary folding hand tool set with a one-piece, completely integral, plastic handle.

FIG. 1 is a perspective view of an exemplary folding hand tool set 20 in which a plurality of hand tools 22*a*–22*i* are retained to a one-piece, completely integral, plastic handle 24 by fasteners 25, 27. The fasteners 25, 27 preferably are threaded proximately only a distal end thereof The hand tools 22*b*–22*i* are located in a first storage position within the handle 24. The hand tool 22*a* is rotated to a second extended position approximately 270° from the one-piece, completely integral, plastic handle 24. It will be understood that the hand tool 22*a* can be rotated approximately 180° to operate similarly to a screwdriver (see FIGS. 7 and 8), or a variety of other positions.

The folding hand tool set 20 is preferably assembled by arranging the tools 22*a*–22*c* in an upright position in a fixture to simulate the second extended position 270° relative to the handle 24, such as illustrated in FIG. 1. The tools 22*d*–22*i* are located in an upright position in an adjacent fixture to simulate a second extended position 90° relative to the handle 24, so that the handle 24 may be engaged with all of the tools 22*a*–22*i* simultaneously. The fasteners 25, 27 are then inserted through the handle 24 and tools 22*a*–22*i* and secured. The fasteners 25, 27 preferably do not rotate with the tools 22*a*–22*i*.

Although the embodiment illustrated in FIG. 1 is shown with a hex-shaped wrench, it will be understood that a variety of hand tools may be included in the folding hand tool set of the present invention, including screwdrivers, Torx® drivers, open end wrenches, box end wrenches or some combination thereof.

Figure 2:
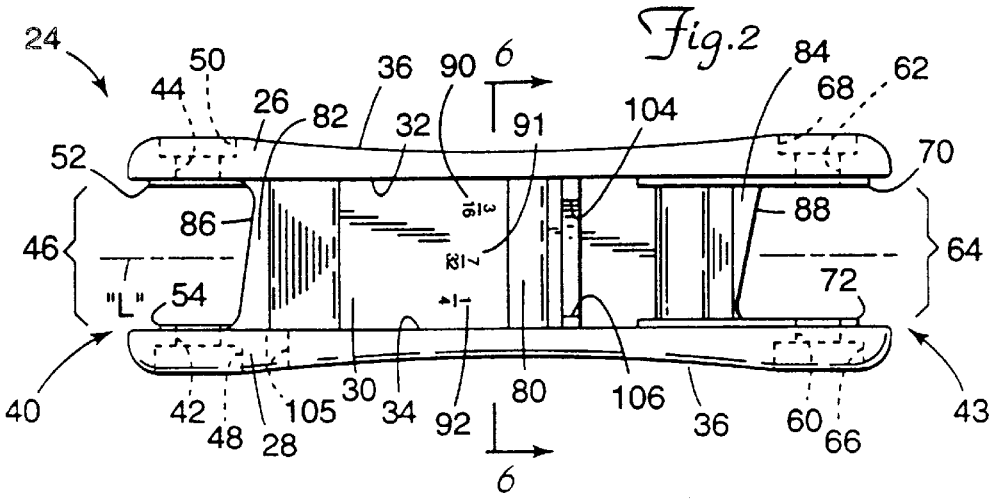
FIG. 2 is a top view of an exemplary one-piece, completely integral, plastic handle for a folding hand tool set.
Figure 3:
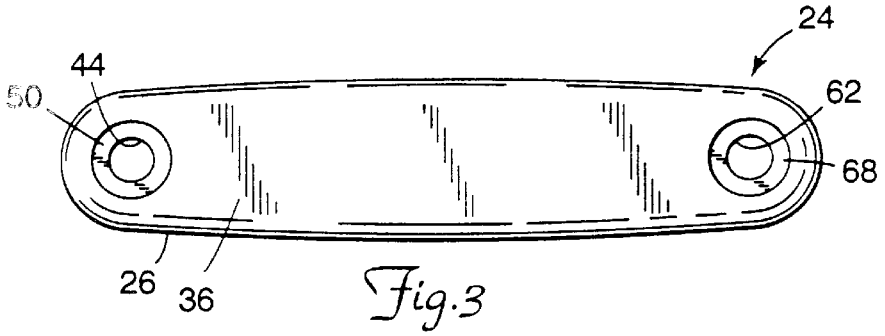
FIG. 3 is a front view of the handle of FIG. 2.
Figure 4:
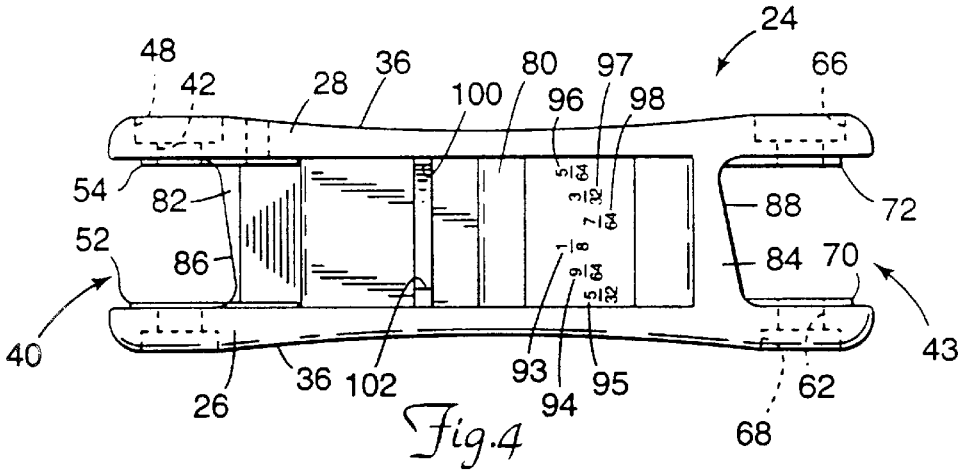
FIG. 4 is a bottom view of the handle of FIG. 2.

FIGS. 2–5 and 11-12 illustrate an exemplary one-piece, completely integral, plastic handle 24 for retaining a plurality of hand tools, such as illustrated in FIG. 1. As illustrated in FIGS. 2 and 4, the one-piece, completely integral, plastic handle 24 includes a first side wall 26 joined to a second side wall 28 by a center rib 30. The center rib 30 extends along the inside surface 32, 34 of the first and second side walls 26, 28 at a center portion 36. The center portion 36 extends generally the full length of the center rib 30 as measured along longitudinal axis L. The distal ends of the first and second side walls 26, 28 form first and second mounting ends 40, 43 for receiving a plurality of hand tools.

The first mounting end 40 includes a pair of holes 42, 44 which are aligned across an opening 46. The outside surface of the second side wall 28 includes a hexagonal recess 48 generally concentric with the hole 42 for receiving a fastener (see FIG. 5). The first side wall 26 includes a circular recess 50 concentric with the hole 44 for receiving the head of a fastener for engagement with the hexagonal fastener in the recess 48 (see FIG. 3). The inside surfaces of the first and second side walls 26, 28 include a pair of opposing raised shoulders 52, 54.

Similarly, the second mounting end 43 includes a pair of opposing holes 60, 62 aligned across an opening 64. The second side wall 28 includes the hexagonal recess 66 generally concentric with the hole 60 for receiving a hexagonal fastener (see FIG. 5). The first side wall 26 includes a circular recess 68 concentric with the hole 62 for receiving the head of a fastener that meets with the hexagonal fastener in the recess 66 (see FIG. 1). The inner surfaces 32, 34 of the first and second side walls 26, 28 respectively, include raised shoulders 70, 72. The shoulders 52, 54, 70, 72 serve to offset the hand tools 22*a*–22*i* from the inner surface 32, 34, to provide additional strength to the first and second mounting ends 40, 43 and to maintain the hand tools 22*a*–22*i* parallel to a longitudinal axis L during rotation.

Tool size indicators 90, 91, 92 are preferably molded into the center rib 30 of the one-piece, completely integral, plastic handle 24. First and second side wall supports 104,106 provide additional structural support to the side walls 26, 28, respectively, and transmit force from the side walls 26, 28 to the center rib 30. The side wall supports 104, 106 also space the tools 22*a*–22*i* from the inner surfaces 32, 34 of the sidewalls 26, 28 to facilitate removal of the hand tools.

Figure 5:
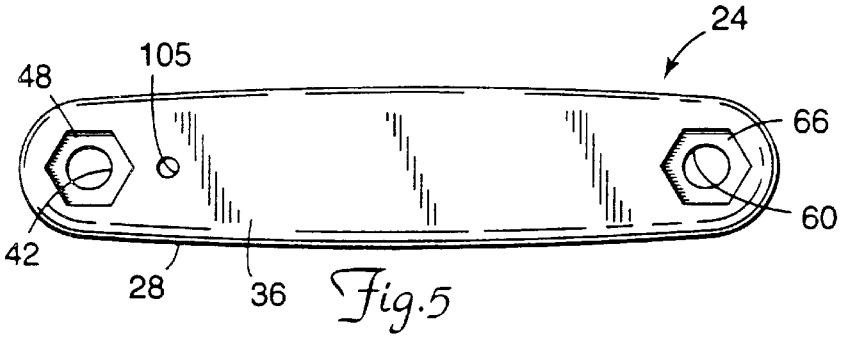
FIG. 5 is a rear view of the handle of FIG. 2.

As best illustrated in FIG. 2, the first and second side walls 26, 28 are curved inward toward the center rib 30 generally along the center portion 36. The handle 24 is wider proximate the mounting ends 40, 43. It will be understood that the sidewalls 26, 28 may alternately be straight or curved outward proximate the center portion 36. As best illustrated in FIGS. 3 and 5, the sidewalls 26, 28 of the handle 24 are curved or bowed outward along the top and bottom edges thereof so that the height or thickness of the sidewalls is greater at the center portion 36 then at the mounting ends 40, 43.

The sidewalls 26, 28 have greater thickness at the mounting ends 40, 43 due to the raised shoulders 52,54, 70, 72, as well as additional thermoplastic material proximate the recesses 48, 50, 66, 68. The greater thickness increases resistance to breakage proximate the first and second mounting ends 40, 43. The narrowness of the handle 24 along the center portion 36 provides for some flexibility in this area.

The curves of the handle 24 enhance comfort for the user but also serves to cantilever some of the torsional forces that are generated when using the tool set 20 from the mounting ends 40, 43 toward the center rib 30, thereby increasing the ultimate strength of the handle 24. Consequently, longitudinal as well as lateral displacement/distortion occurs when the forces that are generated at the first and second mounting ends 40, 43 of the handle 24 are transferred toward the center portion 36 of the handle 24.

Figure 7:
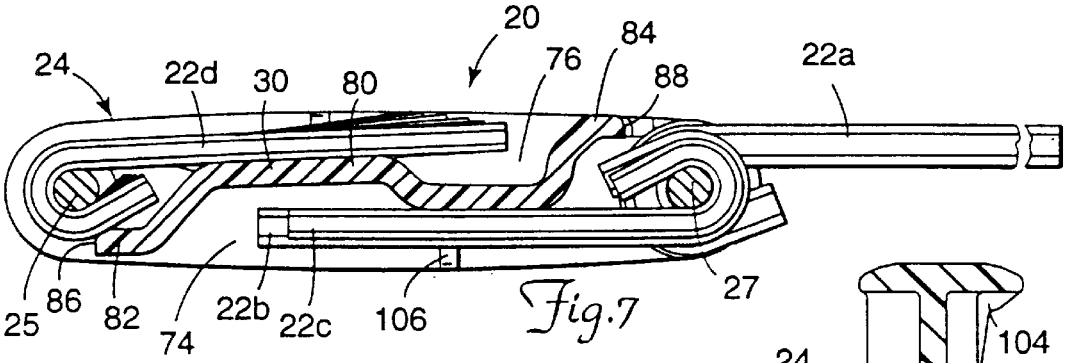
FIG. 7 is a sectional view of the folding hand tool set of FIG. 2 with one of the hand tools rotated approximately 180° from the handle.
Figure 9:
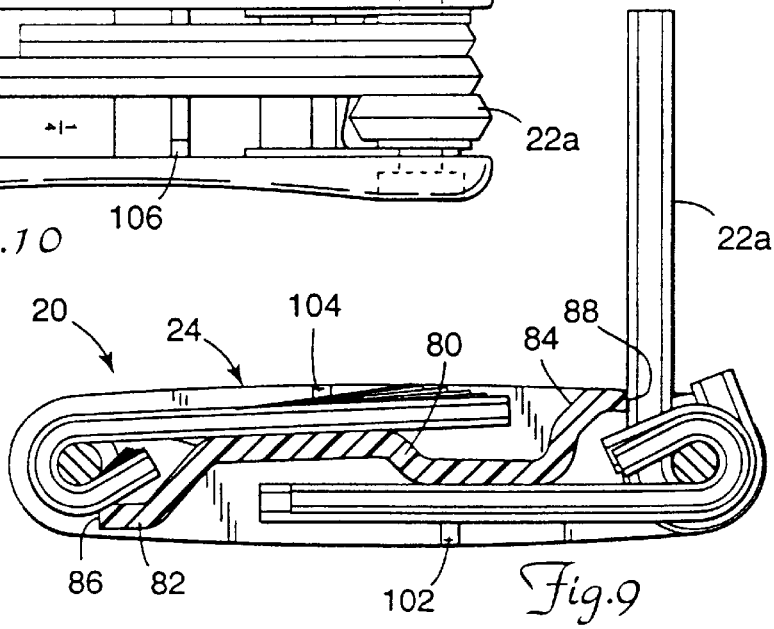
FIG. 9 is a sectional view of the folding hand tool set of FIG. 1 with one of the tools rotated approximately 270° from the handle.
Figure 13:
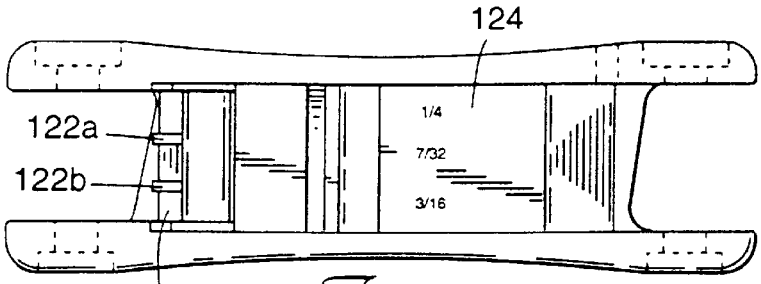
FIG. 13 is an alternate embodiment of a one-piece, completely integral, plastic handle for a folding hand tool set.
Figure 14:
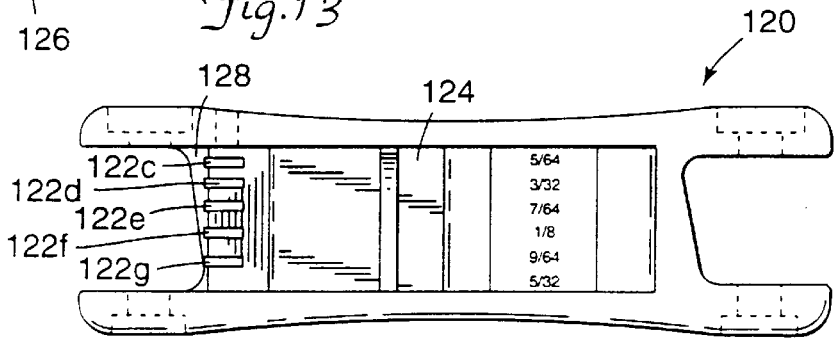
FIG. 14 is a bottom view of the handle of FIG. 13.

The center rib 30 has an S-shaped curve 80 proximate the center portion 36 to provide additional strength to the plastic handle 24 (see also FIGS. 7 and 9). The center rib 30 includes a first reinforcing web 82 located proximate the first mounting end 40. The edge of the reinforcing web 82 serves as an end stop 86 for the hand tools 22*d*–22*i*. Similarly, the center rib 30 includes a second reinforcing web 84 located proximate the second mounting end 43. The edge of the second mounting web serves an end stop 88 for the hand tools 22*a*–22*c* (see FIG. 9). The end stops 86, 88 may be curved or angled to accommodate different diameter tools. For example, the end stop 86 is angled more toward the center portion 36 opposite the ¼ inch tool then opposite the 3/16-inch tool.

Additional tool size indicators 93–98 are molded into the bottom side of the center rib 30, as shown in FIG. 4. A second side wall support 100 may be formed proximately the second side wall 28 along the bottom edge of the center rib 30. Similarly, a first side wall support 102 may be formed opposite the second side wall support 100.

FIG. 5 is a rear view of the one piece plastic handle 24 of FIG. 2. A mounting hole 105 may be provided in the second sidewall 28 for attaching instructional information to the hand tool set 20 and for hanging the tool on a tool belt or tool rack.

Figure 6:
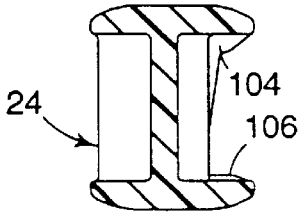
FIG. 6 is a sectional view of the handle of FIG. 2.

FIG. 6 is a sectional view of the handle 24 of FIG. 2 showing the first and second side wall supports 104, 106. It will be understood that the precise shape of the side wall supports may vary considerably without departing from the scope of the present invention.

Figure 11:
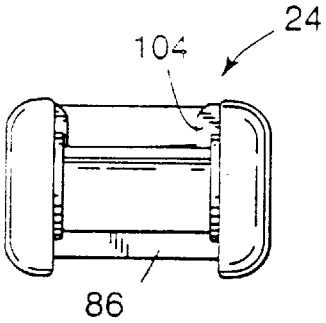
FIG. 11 is a left end view of the handle of FIG. 3.
Figure 12:
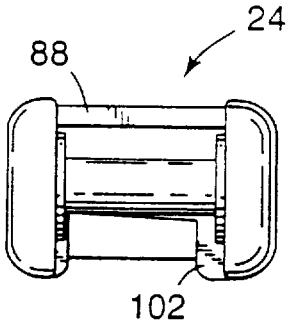
FIG. 12 is a right end view of the handle of FIG. 3.

FIG. 11 is a left end view of the handle 24 of FIG. 3 showing the placement of the first sidewall support 104 and the end stop 86. FIG. 12 is a right end view of the handle 24 of FIG. 3 showing placement of the first sidewall support 102 and the end stop 88.

The present one-piece, completely integral, plastic handle 24 is preferably constructed from a polymeric material. In one embodiment, the plastic handle is constructed from a fiber reinforced thermoplastic formed by injection molding to form a discrete structure or article. The reinforcing fibers are preferably oriented or aligned generally parallel to the longitudinal axis L during the injection molding process to enhance the strength of the handle 24 using injection molding techniques known in the art. Other fiber orientations may be desirable for some applications. The thermoplastic resists cold, heat and corrosive chemicals while providing a comfortable non-slip grip. It will be understood that a variety of non-reinforced plastics may be used instead of the fiber reinforced thermoplastic, although lower levels of torque are likely.

Thermoplastics known to be suitable for use in the present invention include acrylonitrile-butadiene-styrene, acetal, acrylic, polyamide nylon 6—6, nylon, polycarbonate, polyester, polyether etherketone, polyetheride, polyether sulfone, polyphenylene sulfide, polyphenylene oxide, polystyrene, polysulfone, and styrene acrylonitrile. Suitable reinforcing materials include aramid, carbon, glass, polyester or mica fibers, or some combination thereof. The gripping surface preferably has a slightly course or pebbled surface finish in order to provide a non-slip surface. The hand tools 22*a*–22*i* are preferably constructed from high grade tool steel and heat treated to provide maximum torque.

It will be understood that the present handle 24 may be constructed in a variety of sizes, depending upon the number and size of the hand tools and the desired strength of the handle 24. While no specific industry standards exist, common dimensions for handles used in folding hand tool sets are set forth in Table 1 below:

TABLE 1

| Overall Handle Length | Height of Handle Profile (see Figures 3 and 5) |
|---|---|
| 0.1397–0.1524 m (5.5–6.0 inches) | 0.0254–0.0381 m (1–1.5 inches) |
| 0.1080 m (4.25 inches) | 0.0254 m (1 inch) |
| 0.0889 m (3.5 inches) | 0.0191 m (0.75 inches) |
| 0.0762 m (3 inches) | 0.0191 m (0.75 inches) |

Figure 8:
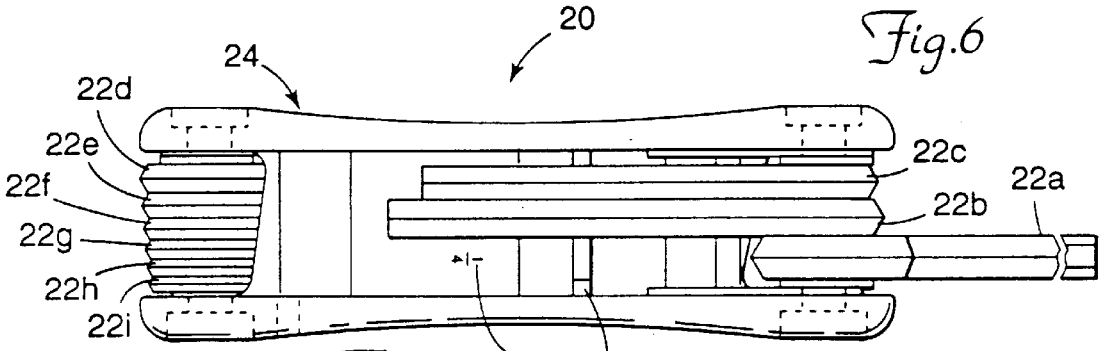
FIG. 8 is a bottom view of the exemplary folding hand tool set of FIG. 7.

FIGS. 7 and 8 illustrate an exemplary folding hand tool set 20 in which one of the hand tools 22*a* is rotated approximately 180° from the one-piece, completely integral, plastic handle 24. As illustrated in the sectional view of FIG. 7, the center rib 30, first reinforcing web 82 and end stop 86 form a first recess 74. The center rib 30, second reinforcing web 84 and end stop 88 form a second recess 76. Fastener 25 retains hand tools 22*d*–22*i* in the handle 24. Fastener 27 retain the hand tools 22*a*–22*c* in the handle 24. As illustrated in FIG. 8, the ¼" designation 92 is exposed, indicating that the ¼" hex tool has been rotated from the first storage position inside the first recess 74 to a second extended position. The second side wall support 106 serves to guide the hand tool 22*a* from the first recess 74 to the second extended position.

Figure 10:
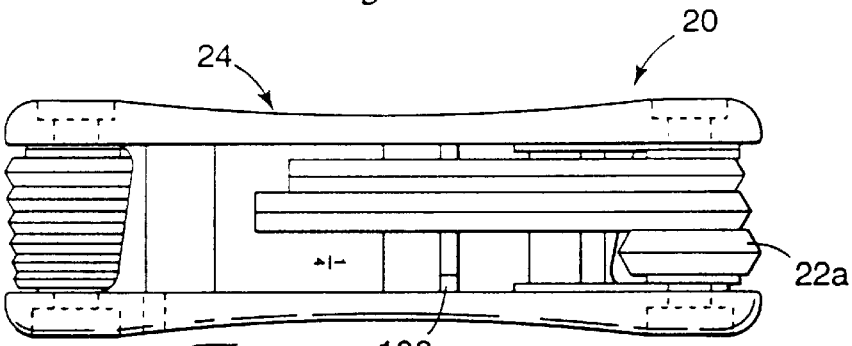
FIG. 10 is a bottom view of the exemplary folding hand tool set of FIG. 9.

FIGS. 9 and 10 illustrate the folding hand tool set 20 of FIGS. 7 and 8 in which the hand tool 22*a* has been rotated approximately 270° relative to the one-piece, completely integral, plastic handle 24. The hand tool 22*a* contacts the end stop 88 of the second reinforcing web 84. The end stop 88 serves to retain the hand tool 22*a* at right angles relative to the handle 24. When rotated 270°, the end stops 86, 88 of the first and second reinforcing webs 82, 84 retain the hand tools at approximately 90° relative to the handle 24, thereby allowing the user to generate the maximum torque while minimizing the possibility that the hand tool will collapse toward the center rib 30 and pinch the user's fingers. The second side wall support 106 serves to guide the hand tool 22*a* from the first recess 74 to the second extended position. It will be understood that the end stops 86, 88 may be adjusted to permit more than 270° of rotation.

Figure 15:
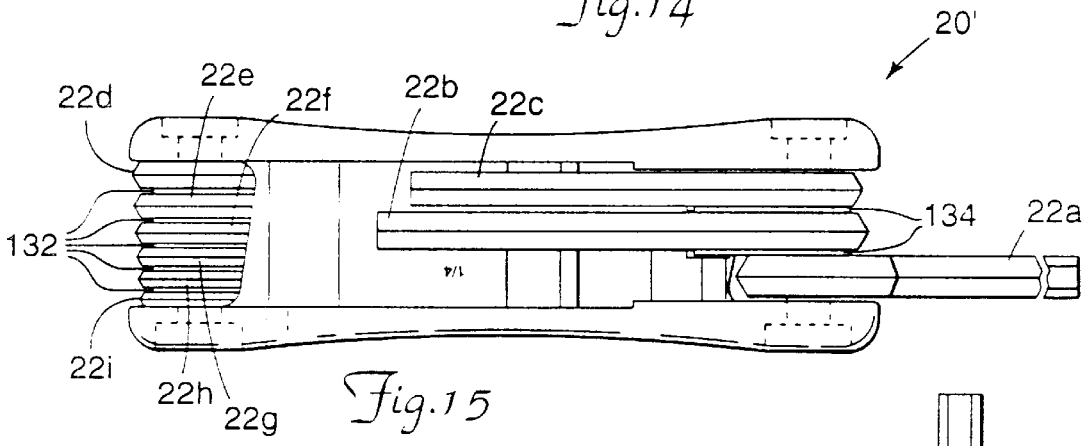
FIG. 15 is a top view of an alternate folding hand tool set utilizing the handle of FIG. 13.

FIGS. 13, 14, 17 and 18 illustrate an alternate one-piece, completely integral, plastic handle 120 for retaining a plurality of hand tools 22*a*–22*i* (see FIG. 15). The handle 120 of FIGS. 13 and 14 generally corresponds to the handle of FIGS. 2 and 4, except that a plurality of slots 122*a*–122*g* are formed in the center rib 124 proximate the reinforcing webs 126, 128.

Figure 16:
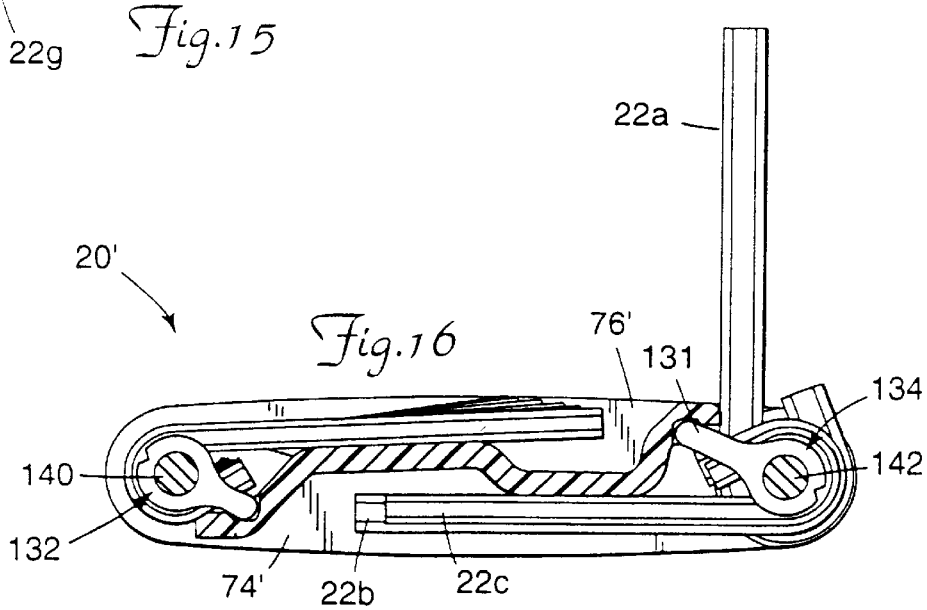
FIG. 16 is a sectional view of the folding hand tool set of FIG. 15.
Figure 17:
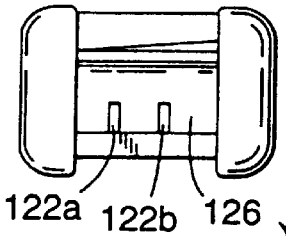
FIG. 17 is a left end view of the handle of FIG. 13.
Figure 18:
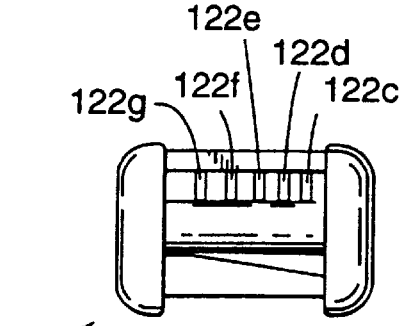
FIG. 18 is a right end view of the handle of FIG. 13.
Figure 19:
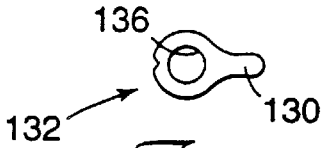
FIG. 19 is a top view of the spacer shown in FIG. 16.
Figure 20:
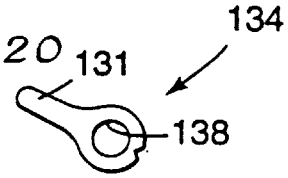
FIG. 20 is a top view of an alternate space shown in FIG. 16.

The slots 122*a*–122*g* are designed to receive distal portions 130, 131 of spacers 132, 134 shown in FIGS. 19 and 20, respectively. The spacers 132, 134 each have a center hole 136, 138 through which the fasteners 140, 142 extend (see FIG. 16). The spacers 132, 134 may be constructed from a variety of materials, such as metal or a polymeric material.

The distal portion 130 of the spacer 132 is sized to accommodate the distance between the axis of the fastener 140 and the slots 122*c*–122*g*. The distal portion 131 of the spacer 134 is sized to accommodate the distance between the axis of the fastener 142 and the slots 122*a*-122*b*. The engagement of the distal portions 130, 131 with the slots 122*a*–122*g* prevents the spacers 132, 134 from rotating. Consequently, each of the tools 22*a*–22*i* of the folding hand tool set 20' of FIGS. 15 and 16 can be rotated from a first position within one of the recesses 74', 76' to an extended position without transmitting torque to adjacent tools

22*a*–22*i*. The fasteners 140, 142 preferably do not rotate with the rotation of the tools 22*a*–22*i*. Mechanically isolating each tool 22*a*–22*i* facilitates usage of the hand tool 22' with one hand.

Figure 21:
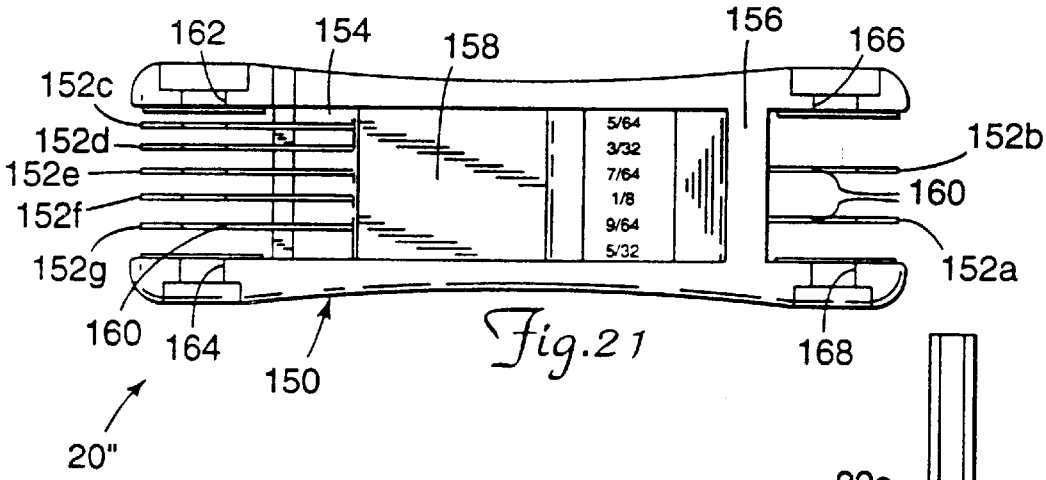
FIG. 21 is a bottom view of an alternate handle with integrally formed spacers.
Figure 22:
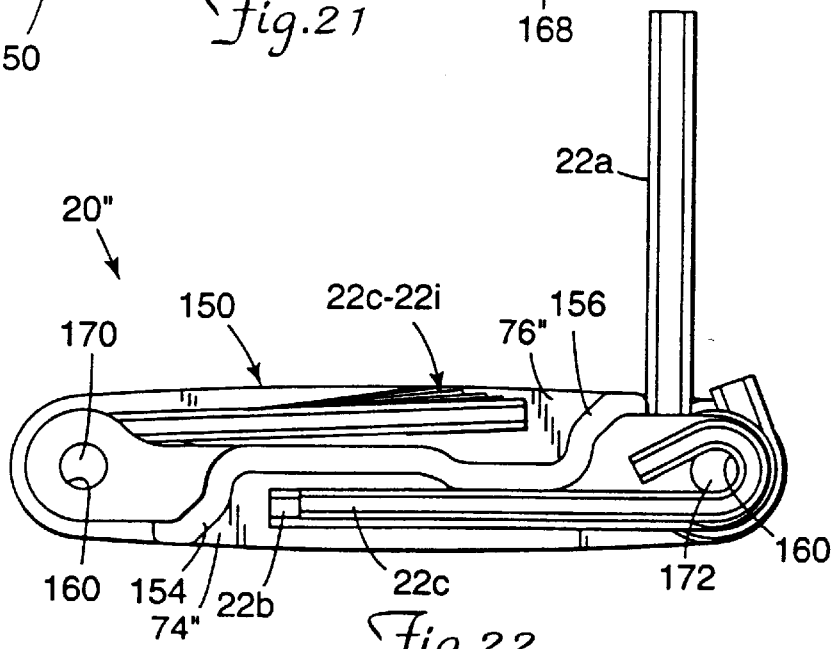
FIG. 22 is a sectional view of a folding hand tool set utilizing the handle of FIG. 21.

FIG. 21 illustrates an alternate one-piece, completely integral, plastic handle 150 for retaining a plurality of hand tools 22*a*–22*i*, illustrated in FIG. 22. The handle 150 of FIG. 21 generally corresponds to the handles of FIGS. 2 and 14, except that a plurality of spacers 152*a*–*g* are integrally formed in the handle 150. The spacers 152*a*–*g* extend from the reinforcing webs 154, 156 of the center rib 158 so that center holes 160 in the spacers 152*a*–*g* are aligned with the holes 162, 164, 166, 168 in the handle 150. As illustrated in FIG. 22, fasteners 170, 172 extend through the tools 22*a*–22*i*, the center holes 160 and the holes 162–168 in the handle 150. Each of the tools 22*a*–22*i* of the folding hand tool set 20" of FIG. 22 can be rotated from a first position within one of the recesses 74", 76" to an extended position without transmitting torque to adjacent tools.

EXAMPLES

Two sizes of a folding hand tool set 20 each having a one-piece, completely integral, plastic handle were compared to various other folding tool set constructions to determine the maximum torque at which the integrity of the handle was compromised. The one-piece, completely integral, plastic handles were constructed of a glass fiber reinforced nylon.

Example 1

A series of hand tools with an overall handle length of approximately 0.1080 m (4.25 inches) and a handle height of approximately 0.0254 m (1.0 inch) were tested. Each hand tool set forth from Table 2 below was placed into a round metal holder that completely encased the handle to within one inch of the tool that was tested. The ¼" hand tool for each handle was rotated 90° from the handle and placed into a hex-shaped hole in a strain gauge transducer until approximately 1" of the tool remained exposed. When pressure was applied to each handle in a rotational fashion, torque was transmitted to the strain gauge and the value of that torque was digitally displayed on the strain gauge readout. The pressure was increased until that handle was permanently damaged or broken, as summarized in Table 2 below.

TABLE 2

| Hand Tool Style | Torque at which permanent damage was done to handle | Torque at which handle broke or split apart |
|---|---|---|
| Two-part zinc die cast handle | — | 87.11 Newton · meters |
| One-part stamped metal handle | 74.12 Newton · meters | 100.22 Newton · meters |
| Two-part plastic handle | — | 95.02 Newton · meters |
| Two-part metal handle w/ plastic grips | — | 72.88 Newton · meters |
| One-piece, completely integral, plastic handle | — | 135.69 Newton · meters |

The one-piece plastic handle transmitted 42.8% more torque then that two-part plastic handle tested and 35.3% more torque then the one-part stamped metal handle.

Example 2

A series of hand tools with an overall handle length of 0.0889 m (3.5 inches) and a handle height of approximately 0.01905 m (0.75 inches) were tested according to the method of Example 1, the results of which are set forth in Table 3 below.

TABLE 3

| Hand Tool Style | Torque at which permanent damage was done to handle | Torque at which handle broke or split apart |
|---|---|---|
| Two-part zinc die cast handle | — | 62.03 Newton · meters |
| One-part stamped metal handle | — | 88.35 Newton · meters |
| Two-part metal handle w/ plastic grips | — | 59.77 Newton · meters |
| One-piece, completely integral, plastic handle | — | 130.27 Newton · meters |

The one-piece, completely integral, plastic handle transmitted 47.5% more torque then the one-part stamped metal handle.

Example 3

A series of handles for various folding hand tool sets with the tools removed were subject to a torsional test, including the present one-piece, completely integral, handle constructed from a glass reinforced nylon. One end of each test handle was gripped to a depth of 0.0254 m (1.0 inch) by a retaining fixture attached to a strain gauge transducer. The other end was gripped to a depth of 0.0254 m (1.0 inch) by a retaining fixture attached to a means for inducing a torque along the length of the handle. When pressure was applied to each handle in a rotational (torsional) fashion, torque was transmitted to the strain gauge and the value of that torque was digitally displayed on the strain gauge readout. The torque was increased until the handle being tested broke, split or collapsed, as summarized in Table 4 below.

TABLE 4

| Hand Tool Style | Handle size | Torque at which handle broke, split or collapsed |
|---|---|---|
| Two-part zinc die cast handle | 0.1080 m × 0.0254 m | 27.46 Newton · meters |
| One-part stamped metal handle | 0.1080 m × 0.0254 m | 21.47 Newton · meters |
| One-piece, completely integral, plastic handle | 0.1080 m × 0.0254 m | 39.43 Newton · meters |
| Two-part zinc die cast handle | 0.0889 m × 0.01905 m | 23.16 Newton · meters |
| One-part stamped metal handle | 0.0889 m × 0.01905 m | 15.93 Newton · meters |
| One-piece, completely integral, plastic handle | 0.0889 m × 0.01905 m | 38.41 Newton · meters |

As is clear from Table 3, the present one-piece, completely integral, plastic handle of the present invention withstood significantly more torque than prior handle constructions.

The present invention has now been described with reference to several embodiments described herein. It will be apparent to those skilled in the art that many changes can be made in the embodiments without departing from the scope of the invention. Thus, the scope of the present invention should not be limited to the structures described herein, but only to structures described by the language of the claims and the equivalents to those structures.

What is claimed is:

1. A folding hand tool set, comprising:

a one-piece, completely integral, plastic handle constructed from a polymeric material including first and second elongated side walls having an outer gripping surface arranged in a generally parallel configuration and joined along an inner surface thereof by a center rib, at least a portion of the center rib having a non-planar cross section along a longitudinal axis of the handle, the elongated side walls defining at least one mounting end, the center rib being positioned to form at least one recess for receiving hand tools along the longitudinal axis; and a plurality of hand tools rotatably mounted to the at least one mounting end, the hand tools being rotatable from a first position within the at least one recess to a second extended position.

2. The apparatus of claim 1 wherein the center rib further comprises a reinforcing web proximate the at least one mounting end forming a portion of the at least one recess.

3. The apparatus of claim 2 wherein the reinforcing web forms an end-stop for at least one of the hand tools when in the second extended position.

4. The apparatus of claim 1 wherein the second extended position of at least one of the hand tools is approximately 270 degrees from the first position.

5. The apparatus of claim 1 wherein the polymeric material comprises a fiber reinforced thermoplastic material.

6. The apparatus of claim 5 wherein the fibers are oriented generally parallel to the longitudinal axis of the handle.

7. The apparatus of claim 5 wherein the fibers are selected from a group consisting of aramid, carbon, glass, polyester or mica, or combinations thereof.

8. The apparatus of claim 1 wherein torque of at least 110.0 Newton·meters may be transmitted through the handle to one of the hand tools without compromising the integrity of the one-piece, completely integral, handle.

9. The apparatus of claim 1 wherein torque of at least 120.0 Newton·meters may be transmitted through the handle to one of the hand tools without compromising the integrity of the one-piece, completely integral, handle.

10. The apparatus of claim 1 wherein at least a portion of the gripping surface is curved inward toward the center rib proximate a center portion, to cantilever a portion of torsional forces generated when using the tool set from the mounting end toward the center rib.

11. The apparatus of claim 1 further including spacer means for rotationally isolating at least two adjacent hand tools.

12. The apparatus of claim 11 wherein the spacer means comprise spacers integrally formed in the handle rotationally isolating at least two adjacent hand tools.

13. The apparatus of claim 11 wherein the spacer means comprise discrete spacer elements fixedly engaged with the handle and positioned between at least two of the plurality of hand tools proximate at least one of the mounting ends.

14. The apparatus of claim 1 wherein the handle further comprises a plurality of spacers integrally formed in the handle to rotationally isolated at least two adjacent hand tools.

15. The apparatus of claim 1 wherein the at least one recess comprises two recesses.

* * * * *